US006742582B1

(12) United States Patent
Wheat et al.

(10) Patent No.: US 6,742,582 B1
(45) Date of Patent: Jun. 1, 2004

(54) MODULAR CLIMATE CONTROL UNIT

(75) Inventors: Parker Wheat, Hollis, NH (US); Barry Spouge, Ingatestone (GB); Gary Webster, Bicknacre (GB)

(73) Assignee: Vent-Rite Valve Corp., Randolph, MA (US)

( * ) Notice: Subject to any disclaimer, the term of this patent is extended or adjusted under 35 U.S.C. 154(b) by 0 days.

(21) Appl. No.: 09/488,282

(22) Filed: Jan. 20, 2000

(51) Int. Cl.[7] ..... F25B 29/00
(52) U.S. Cl. ..... 165/259; 165/247; 165/50
(58) Field of Search ..... 165/53, 54, 55, 165/57, 50, 122, 259, 247

(56) References Cited

U.S. PATENT DOCUMENTS

| | | | | | |
|---|---|---|---|---|---|
| 3,074,477 | A | * | 1/1963 | Whalen | 165/55 X |
| 3,129,753 | A | * | 4/1964 | Davis et al. | 165/55 |
| 3,252,258 | A | * | 5/1966 | Blickman et al. | 165/53 X |
| 3,403,725 | A | * | 10/1968 | Miner | 165/54 X |
| 3,648,766 | A | | 3/1972 | Whalen | |
| 3,668,887 | A | | 6/1972 | Riello | 62/262 |
| 3,708,011 | A | | 1/1973 | Serratto | |
| 3,765,476 | A | | 10/1973 | Whalen | |
| 3,908,750 | A | * | 9/1975 | Siegel | 165/50 X |
| 3,926,249 | A | | 12/1975 | Glancy | |
| 3,958,628 | A | | 5/1976 | Padden | |
| 4,108,238 | A | * | 8/1978 | Vary et al. | 165/57 |
| RE30,245 | E | | 4/1980 | Whalen | |
| 4,410,033 | A | | 10/1983 | Wawro et al. | |
| 4,505,328 | A | * | 3/1985 | Schmitt | 165/53 |
| 4,550,773 | A | * | 11/1985 | Martin | 165/54 |
| 4,817,708 | A | * | 4/1989 | Ono et al. | 165/54 |
| 5,038,577 | A | | 8/1991 | Stanford | 62/262 |
| 5,152,336 | A | * | 10/1992 | Wollaber et al. | 165/122 X |
| 5,220,955 | A | * | 6/1993 | Stokes | 165/54 |
| 5,226,595 | A | | 7/1993 | Devera et al. | |
| 5,335,721 | A | | 8/1994 | Wollaber et al. | 165/122 |
| 5,361,981 | A | | 11/1994 | Albert et al. | 236/42 |
| 5,890,373 | A | | 4/1999 | Smith | 62/428 |
| 5,924,300 | A | | 7/1999 | Fromm et al. | 62/259.1 |

FOREIGN PATENT DOCUMENTS

| | | | | |
|---|---|---|---|---|
| EP | 0 235 007 | | 9/1987 | |
| FR | 1223503 | | 6/1960 | |
| FR | 1317409 | | 5/1963 | |
| GB | 618620 | | 2/1949 | |
| JP | 59-60132 | * | 4/1984 | 165/57 |
| JP | 59 056027 | | 7/1984 | |
| JP | 61 036633 | | 7/1986 | |
| JP | 63 263332 | | 2/1989 | |
| JP | 2-64331 | * | 3/1990 | 165/54 |
| JP | 04 263716 | | 2/1993 | |
| JP | 08 028897 | | 6/1996 | |
| JP | 08 200795 | | 12/1996 | |
| JP | 09 068324 | | 7/1997 | |
| JP | 11 183076 | | 10/1999 | |

* cited by examiner

*Primary Examiner*—Ljiljana Ciric
(74) *Attorney, Agent, or Firm*—Choate, Hall & Stewart; Valarie B. Rosen

(57) ABSTRACT

An apparatus for internal climate control. The apparatus comprises an inlet and outlet for air, a tangential fan that rotates about a vertically oriented axis, a fan coil assembly through which air is circulated by the tangential fan from the inlet to the outlet, a barrier to prevent recirculation of the air within the apparatus after it is circulated over the fan coil assembly, and a joint to provide fluidic communication with a source of recirculating fluid. The fan coil assembly is connected in series to the source of recirculating fluid and provides thermal communication between the recirculating fluid and the circulating air.

24 Claims, 4 Drawing Sheets

MODULAR CLIMATE CONTROL UNIT

FIELD OF THE INVENTION

This invention relates to a modular climate control unit, specifically to a unit exhibiting improved efficiency and a small footprint.

BACKGROUND OF THE INVENTION

A variety of climate control systems are used for heating and cooling in taller buildings, in which circulating water is used as a heat exchange medium for both heating and cooling. The water is heated or cooled at a central apparatus, and a pump is used to circulate the water through a closed circuit connected to heat exchangers in each room and back to the apparatus for reheating or recooling. It is desirable that the climate control unit in each room occupy as little working or living space as possible. Naturally, it is also desirable that the unit be quiet, so as not to distract the occupant. Furthermore, because of the large number of rooms in a given building, it is desirable to have a climate control unit which can be installed easily and quickly, minimizing installation time during construction, yet allowing for easy maintenance throughout the life of the building. To reduce construction costs and simplify plumbing, it is also desirable to have a climate control unit which can be used for both heating and cooling.

SUMMARY OF THE INVENTION

In one aspect, the invention is an apparatus for climate control. The apparatus includes an air inlet, a tangential fan, a fan coil assembly, a barrier to prevent recirculation of air within the apparatus after it passes through the fan coil assembly, a joint to provide fluidic communication with a source of recirculating fluid, and an air outlet. The coil assembly connected in series to the circuit through which the recirculating fluid circulates and provides thermal communication between fluid flowing from and to the source of recirculating fluid and the circulating air. Air is circulated from the inlet through the coil assembly to the outlet by the fan. The apparatus may also include a plurality of fans, and these fans may be oriented vertically and disposed one over the other. For example, the apparatus may comprise two, three, or four fans. The fan coil assembly may provide thermal communication between fluid returning to the source of recirculating fluid and the circulating air. The assembly may include a plurality of pipes which are connected to first and second manifolds located at each end of the fan coil assembly. For example, the coil assembly may comprise six pipes or two sets of six pipes. In the latter case, the first set of pipes is connected to a set of manifolds at each end of the fan coil assembly, and the second set of pipes is connected to separate manifolds which are also disposed at each end of the fan coil assembly. The joint may comprise a pipe connector, and the fan coil assembly may include a plurality of pipes in fluidic communication with the source of re-circulating fluid and a plurality of fins in thermal communication with the plurality of pipes. The fins may be arranged parallel to each other with a density of about 12 fins/inch. The fins may comprise condensate drip lips. The air inlet may have a smaller surface area than the air outlet, and the apparatus may include a baffle disposed along an airflow path between the fan coil assembly and the outlet. The apparatus may be configured to fit between two adjacent studs within a wall of a room. This may include configuring the apparatus to be at most 9.2 cm deep and 35 cm wide. The apparatus may be about 86.4, 130, or 173 cm tall and include two, three, or four fans, respectively. The apparatus may also comprise of an adjustable thermal static control or an adjustable speed control, enabling the fan to be operated at a variety of speeds. The source of recirculating water may include a heat exchanger.

In another aspect, the invention is a method for adjusting air temperature, including employing a tangential fan to direct air over a fan coil, directing fluid through the fan coil, and adjusting the temperature of the fluid to cool or heat the air. The fan coil provided thermal communication between the air and the fluid. The method may further include recirculating the fluid or orienting the fan vertically. Recirculated fluid may be passed through a heat exchanger. The method may also include the employment of a plurality of fans. The method may also include drying the air from a first generally enclosed space and directing the air into either the first or a second generally enclosed space. The method may also include adjusting the speed of the fan or controlling the air temperature of the generally enclosed space thermostatically. This step of controlling may include causing the fan to go on and off in response to a preset change in air temperature. The method may further include disposing the fan and the fan coil within a space defined by two adjacent studs in a wall.

BRIEF DESCRIPTION OF THE DRAWINGS

The invention is described with reference to the several figures of the drawing, in which.

DETAILED DESCRIPTION

Figure 1A:
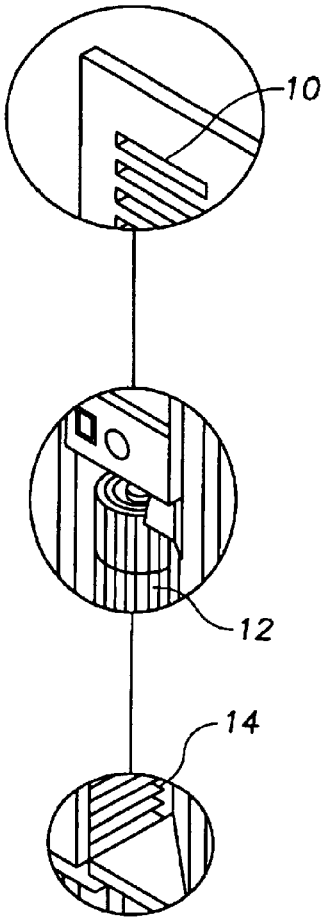
FIG. 1*a* is a schematic diagram of the air path in an exemplary climate control unit according to the invention.
Figure 1B:
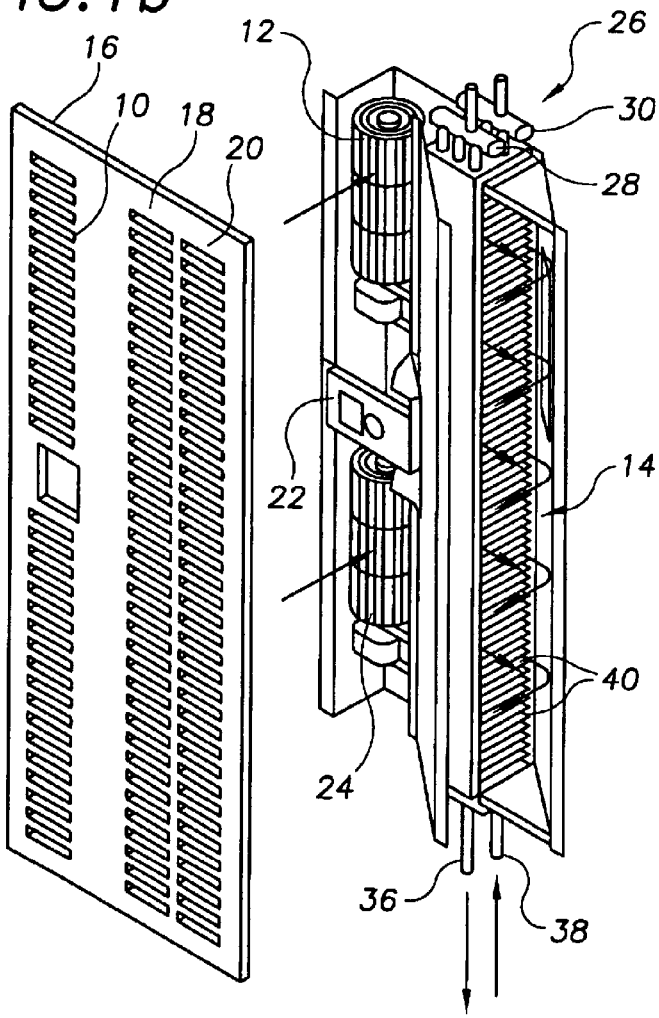
FIG. 1*b* is a diagram of the interior of the exemplary climate control unit, showing its relationship to an exterior cover of the unit.
Figure 2:
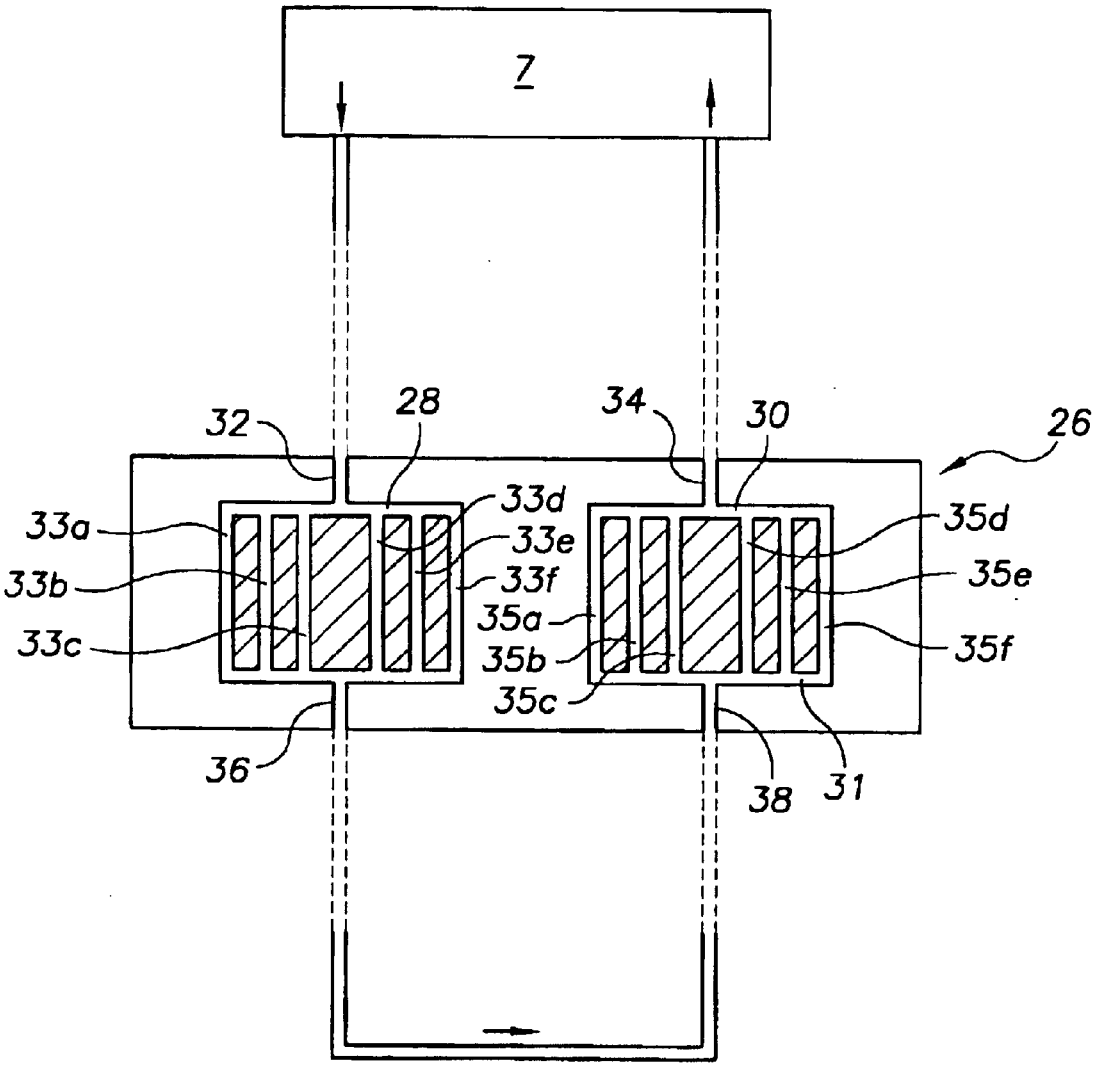
FIG. 2 is a diagram of the water flow path in a climate control unit which has been integrated into a central heating and cooling system.
Figure 3:
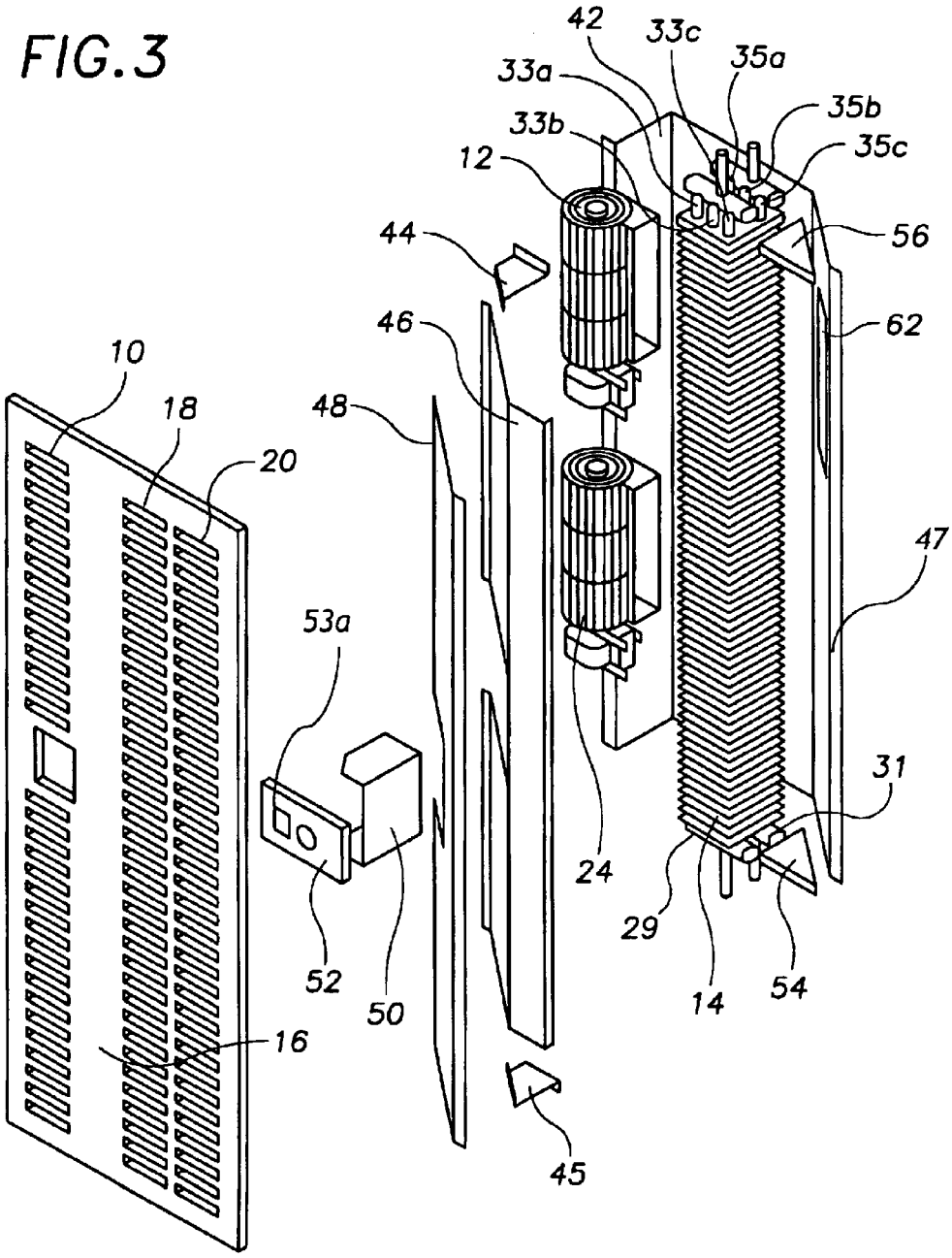
FIG. 3 is a blow-up view of the exemplary climate control unit.

The invention is a vertical, wall recessed climate control unit 5 connected to a water circulation system. Several units, located on several floors of a building, define a water circulation circuit connected to a water heating or cooling system 7 in the building; heat exchange is performed by an aluminum fin/copper tube water coil assembly and vertically oriented tangential fans which circulate air from the room through the coil. Each unit can be controlled to maintain a specific room at a given temperature. FIG. 1*a* shows a diagram of the air path in a climate control unit 5 according to the invention. The air is drawn into the unit 5 through an input louver 10 by a vertical fan 12, which circulates the air through a coil assembly 14. FIG. 1*b* shows a diagram of the climate control unit 5, from which a grill 16 has been removed to ease viewing. Control panel 22 is actually mounted to the "internal" portion of the climate control unit 5. The unit includes vertical fans 12 and 24. Fans 12 and 24 are tangential fans, which reduce the noise generated by the unit 5. The unit may include additional fans to increase throughput. Fluid is provided to coil assembly 14 through pipe assembly 26. Pipe assembly 26 includes upper manifolds 28 and 30 and corresponding lower manifolds 29 and 31 (FIG. 3). The manifolds 28-31 are connected to the water circulation circuit by connecting pipes 32, 34, 36, and 38. In addition, upper manifolds 28 and 30 are connected to their respective lower manifolds 29 and 31 by a set of six copper tubes 33*a–f* and 35*a–f* which extend through the coil assembly 14 and are in thermal communication with fins 40. The twelve copper tubes 33 and 35 distribute the heat exchange capacity of the water circulating through the building across the surface of fins 40, providing a more regular heat distribution than would be provided by fewer (e.g., 2) tubes. The combination of the manifolds 28, 29, 30, and 31, upper and lower pipe connectors 32, 34, 36, and 38, and the twelve copper tubes 33 and 35*a–f* carry water from and to the building's water heating or cooling system 7. For example, water may come from the system 7 via any intervening units through pipe connector 32 and manifold 28 (FIG. 2). One skilled in the art will understand that system 7 may include one or more of a compressor, boiler, heat exchanger, and other elements necessary to reheat or recool water returning from climate control units. The water is distributed from the manifold 28 into copper tubes 33*a–f* which reunite at the bottom of the coil assembly 14 in lower manifold 29. Water is then conducted to a lower, adjacent unit through pipe connector 36. Water returning to the system 7 enters the unit 5 through pipe connector 38 and is distributed to copper tubes 35*a–f* by lower manifold 31. The water flows upward through the coil assembly 14 into upper manifold 30, from which it is conducted to adjacent, higher units through pipe connector 34. Alternatively, either pipe connectors 36 and 38 or pipe connectors 32 and 34 may be connected to each other to prevent circulation of water to adjacent units or to recirculate the water if there is no adjacent unit. Of course, the central water heating or cooling system 7 may be located beneath the building, reversing the flow direction described above.

FIG. 3 shows the individual components of the climate control unit 5. The unit 5 is assembled within a one-piece chassis 42 which can be inserted into a wall cavity during installation. The chassis 42 is preferably fabricated from zinc coated sheet metal. Vertical tangential fans 12 and 24 are fixed to the chassis 42 via screw joints. Coil cover support brackets 44 and 45 are also preferably fabricated from zinc coated mild sheet steel and are formed with flanges to secure them and a coil cover 46 to the chassis. As noted above, air enters the unit 5 through input louver 10 in grill 16. The air is drawn into fans 12 and 24 and directed by them through coil assembly 14. Coil cover 46 prevents the escape of air from the unit 5 as it leaves the fans 12 and 24 and directs air flow from the fans 12 and 24 through coil assembly 14. It is preferably manufactured from zinc coated mild sheet steel ("galvanized steel") and secured with screw joints to coil cover support brackets 44 and 45. After air passes through coil assembly 14, baffle 47 directs the air towards output louvers 18 and 20. An internal barrier 48 prevents recirculation of air from coil assembly 14 through the tangential fans 12 and 24. Control panel bracket 50 helps secure control panel 52, which is mounted onto chassis 42. It also serves as a second internal barrier, helping to prevent recirculation of air from the coil assembly through the tangential fans. In the two-fan embodiment shown in the figures, control panel bracket fits between tangential fans 12 and 24. In a unit with more fans, the bracket 50 (and control panel 22) may be situated between any two fans. Control panel bracket 50 is preferably manufactured from zinc coated mild sheet steel and secured with screw joints to the chassis 42. Lower outlet internal barrier 54 is secured to the chassis with screw joints on its formed flanges and is preferably manufactured from zinc coated mild sheet steel. The lower internal barrier 54 prevents air from escaping through the bottom of the unit 5 after it has passed through the coil assembly 14. Upper outlet internal barrier 56 is similarly fabricated and mounted and prevents the escape of air through the top of the unit 5. Grill 16 covers the complete internal mechanism of the unit 5 and is screwed to the chassis 42. It includes inlet louver 10 and outlet louvers 18 and 20 to provide air circulation into and out of the unit 5 and an opening for access to control panel 22. The grill 16 is preferably paint finished and manufactured from zinc coated mild sheet steel; the edges are folded over for both safety and airtightness.

The unit can be used for heating, cooling, or dual climate control. For units incorporating a cooling function, lower outlet internal barrier 54 will preferably include a waterproofing coating. In addition, fins 40 will preferably incorporate condensate drip lips.

Figure 4:
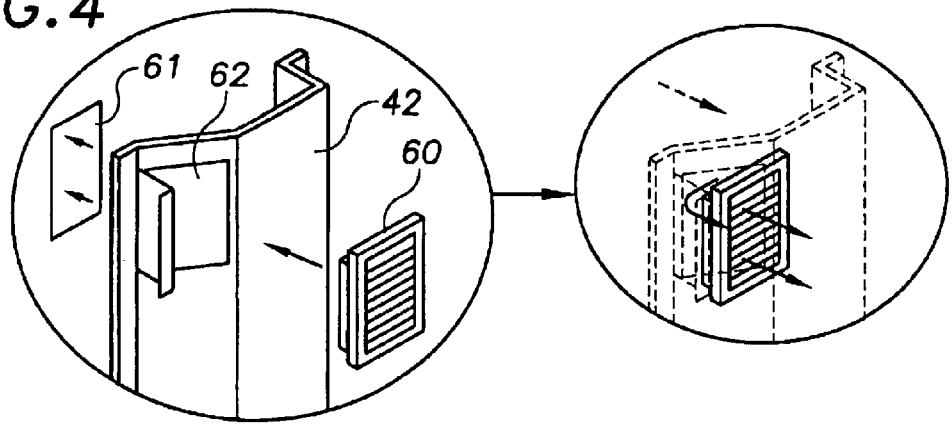
FIG. 4 depicts a configuration of the unit for reverse air flow operation.

The output louvers 18 and 20 are designed to allow air to circulate from and to the same room. However, it is not necessary to pass cooled or heated air back into the room from which it came. The unit 5 can discharge a portion of the heated or cooled air received through input louver 10 into an adjacent room using a smaller grill and bracket assembly 16 which is secured to the rear of chassis 42 over an opening 62 (FIG. 4). To use the reverse air flow mode, a panel 61 is disposed over a portion of output louvers 18 and 20, preventing full air escape therethrough. Then, the unit 5 will direct heated or cooled air rearwards through rear grill bracket assembly 60.

While the temperature of the flowing water determines whether the unit functions as a heater or air conditioner, more precise control of room temperature is available via the control panel 52. A thermostat is available to increase the precision of temperature control. A separate switch 53*a* on panel 52 allows the room's occupant to adjust the air flow generated by the fans 12 and 24. In a preferred embodiment, the fans run at two speeds. However, one skilled in the art will easily observe that the fans can be designed to run at a variety of speeds.

The climate control unit has several advantages over prior art units. Use of vertically oriented tangential fans reduces the width of the unit, enabling it to fit between two studs in a wall without having to project into the room and reducing the footprint of the unit 5 while increasing air flow efficiency. Fans can be added to the unit without increasing its width. The copper tubes 33*a–f* and 35*a–f* all contribute to heat exchange. Both the water traveling from system entering the unit 5 at pipe connector 36 and leaving it at 32 and the returning water flowing via pipe connectors 34 and 38 contribute to heat exchange. The twelve tubes 33*a–f* and 35*a–f* are evenly distributed over each individual fin 40, minimizing thermal diffusion lengths from any point on fin 40 to a tube. In comparison, conventional units frequently require that either the coolant supply or return system be external to the coil assembly, where it cannot contribute to heat exchange.

In addition, only four connections are required to integrate the unit 5 into a complete heating and cooling system for a building. An adjacent unit on an upper floor is connected through its own pipe connections to pipe connectors 32 and 34, and an adjacent unit on a lower floor is attached through joints to connectors 36 and 38. In addition to the increased density of the copper pipes, an increased density of fins 40 contributes towards improved thermal conduction.

Prior art climate control units have approximately 4 to 6 aluminum fins per inch of tubing. In addition, prior art climate control units utilize a lower front grill intake and an upper front grill outlet. That is, the input and output louvers are not side by side; the output louvers are disposed above the input louvers. In a preferred embodiment, the unit of the invention has about 12 fins per inch, increasing heat exchange with a given volume of air, and exploits the full vertical length of grill 16 by using one half for the inlet and the other half for the outlet. These two innovations increase the efficiency of heat exchange for both air cooling and heating. The double size outlet, in comparison to the inlet, further enhances air flow and fan performance.

Figure 5:
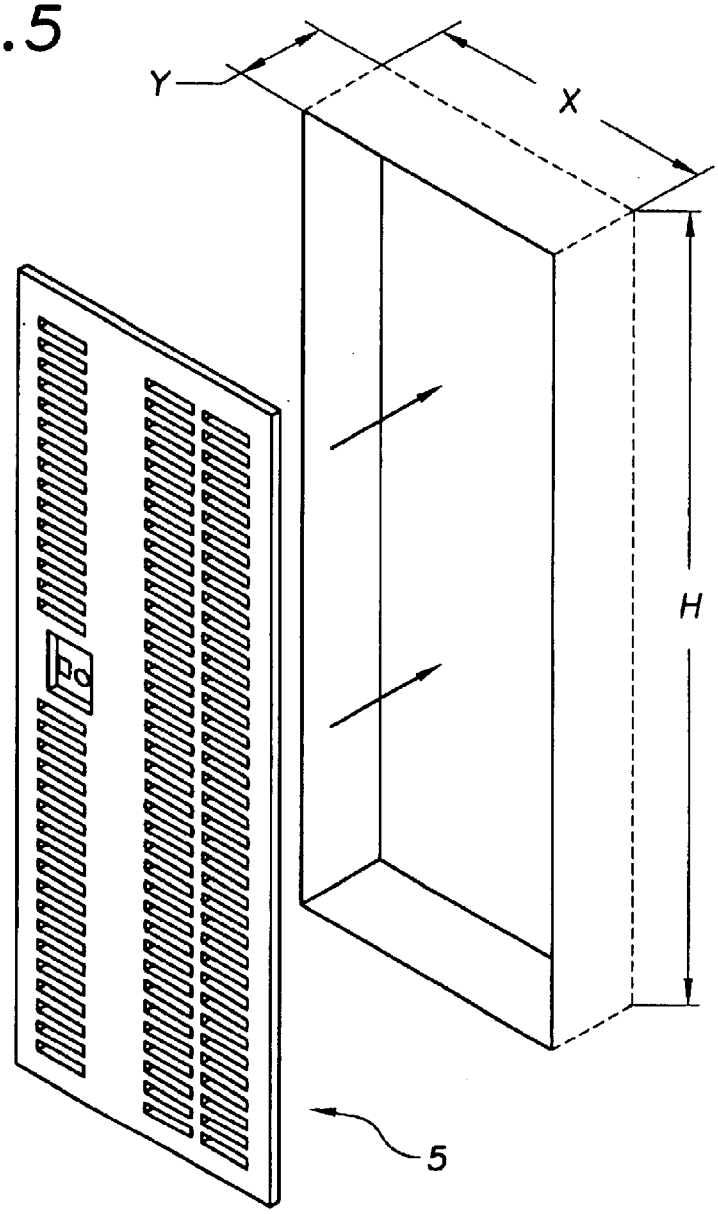
FIG. 5 is a diagram of the space required for installation of a climate control unit according to the invention.

As noted above, unit 5 can fit between two studs (FIG. 5, x=14 in. [35 cm]) within a wall (y=3⅝ in. [9.2 cm]) and only requires a single cover, grill 16. The unit 5 itself can be produced in a variety of heights h (e.g., 34 in. [86.4 cm], 51 3/16 in. [130 cm], 68 ⅛ in. [173 cm]). Taller units can incorporate additional fans. For example, the 130 cm fan may comprise three fans, and the 173 cm fan may include four. The added fans increase the air flow capacity of the unit. For example, if a two fan unit can generate airflows of 1084 and 1578 l/min at its minimum and maximum speed settings, a three fan unit with the same type of fans will generate airflows of 1626 and 2367 l/min. Likewise, a four fan unit will generate airflows of 2168 and 3156 l/min at its minimum and maximum settings, respectively. The compact, self-contained design of the unit of the invention eases both installation and maintenance. To access any of the components for repair or replacement, it is only necessary to unscrew and remove grill 16.

In addition, it is not necessary that the unit be vertically oriented. If the fans are oriented horizontally, then the unit can be configured to extend across part of the width of a wall in a room. Of course, in this case, the unit will not fit between normal wall studs. The horizontal unit is preferably incorporated into the original design of the building and installed as part of the original construction. Furthermore, connecting pipes 32, 34, 36, and 38 should be fitted with elbows to facilitate connection to the building's water circulation system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for internal climate control, comprising:

a plurality of heat exchange modules, each comprising:

an air outlet;

an air outlet;

at least one tangential fan disposed to rotate about a vertically oriented axis, wherein the tangential fan is configured to direct air such that air enters the inlet and leaves the outlet at approximately the same vertical distance from a floor level;

a coil assembly through which air is circulated by the at least one tangential fan from the air inlet to the air outlet; and a barrier to prevent re-circulation of the air within the heat exchange module after the air is circulated over the coil assembly; and a first joint to provide series fluidic communication between the coil assembly and the coil assembly of an adjacent heat exchange module.

2. The apparatus of claim 1, wherein the heat exchange module comprises a plurality of tangential fans.

3. The apparatus of claim 2, wherein the plurality of fans are disposed to rotate about a common axis.

4. The apparatus of claim 2, wherein the apparatus comprises two, three, or four fans.

5. The apparatus of claim 1 wherein the coil assembly comprises a plurality of pipes and first and second manifolds at each end of the coil assembly to which the plurality of pipes are connected.

6. The apparatus of claim 5, wherein the coil assembly comprises six pipes.

7. The apparatus of claim 6, wherein the coil assembly comprises first and second sets of six pipes, wherein the first set of pipes is connected to first and second manifolds, wherein the second set of pipes is connected to third and fourth manifolds, and wherein the first and third manifolds are at a first end of the fan coil assembly and the second and fourth manifolds are at a second end of the fan coil assembly.

8. The apparatus of claim 7, wherein the first and third manifolds are connected to the first joint.

9. The apparatus of claim 7, wherein the second and fourth manifolds are connected to a second joint that provides series fluidic communication between the coil assembly and the coil assembly of a second adjacent heat exchange module.

10. The apparatus of claim 1, wherein the joint comprises a pipe connector in fluidic communication with the coil assembly.

11. The apparatus of claim 1, wherein a flow path through the air inlet has a smaller cross-sectional area than a flow path through the air outlet.

12. The apparatus of claim 1, further comprising a baffle disposed along an air flow path between the coil assembly and the air outlet.

13. The apparatus of claim 1, wherein the apparatus is at most 9.2 cm deep and 35 cm wide.

14. The apparatus of claim 1, wherein the apparatus is about 86.4 cm, 130 cm, or 173 cm tall.

15. The apparatus of claim 14, wherein the apparatus is about 86.4 cm tall and comprises at least two tangential fans.

16. The apparatus of claim 14, wherein the apparatus is about 130 cm tall and comprises at least three tangential fans.

17. The apparatus of claim 14, wherein the apparatus is about 173 cm tall and comprises at least four tangential fans.

18. The apparatus of claim 1, further comprising an adjustable speed control that allows the at least one tangential fan to be operated at a plurality of speeds.

19. The apparatus of claim 1, wherein the apparatus comprises a plurality of heat exchange modules having coil assemblies, wherein the coil assemblies are in series fluidic communication.

20. The apparatus of claim 1, wherein an entry into the air inlet and an exit from the air outlet are substantially co-planar.

21. The apparatus of claim 1, wherein each coil assembly is connected in series to a source of recirculating fluid that is spaced apart from the heat exchange module, and each coil assembly is adapted and constructed to provide thermal communication between fluid flowing from the source of recirculating fluid and the air to heat or cool the air to a predetermined temperature.

22. The apparatus of claim 21, wherein the coil assembly comprises a plurality of pipes in fluidic communication with the source of recirculating fluid and a plurality of fins in thermal communication with the plurality of pipes.

23. The apparatus of claim 22, wherein the fins are arranged parallel to one another with a density of about 12 fins per inch.

24. The apparatus of claim 21, wherein the coil assembly provides thermal communication between fluid returning to the source of recirculating fluid and the air circulated by the tangential fan.

* * * * *